US005577653A

United States Patent [19]

Bieker

[11] Patent Number: 5,577,653

[45] Date of Patent: Nov. 26, 1996

[54] BLOOD COLLECTION TUBE HOLDER

[76] Inventor: Michael C. Bieker, 6358 Los Altos Dr., Rockford, Mich. 49341

[21] Appl. No.: 367,838

[22] Filed: Dec. 30, 1994

Related U.S. Application Data

[63] Continuation-in-part of Ser. No. 257,685, Jun. 9, 1994.

[51] Int. Cl.[6] ..... A45F 5/00

[52] U.S. Cl. ..... 224/684; 224/148.1; 224/660; 224/676; 224/681; 224/245; 224/251; 604/403

[58] Field of Search ..... 224/221, 222, 224/224, 239, 240, 242, 245, 251, 902, 904, 148, 660, 676, 677, 680, 681, 682, 684, 148.1, 148.7, 148.5; 2/3.1, 3.2; D3/229; 604/403, 408, 409; 206/803, 569, 570, 370, 438

[56] References Cited

U.S. PATENT DOCUMENTS

| | | | |
|---|---|---|---|
| D. 215,516 | 9/1969 | Knigge | 224/904 |
| 545,444 | 9/1895 | Bringham | 224/224 |
| 2,758,798 | 8/1956 | Schmidt | 224/245 |
| 4,796,790 | 1/1989 | Hamilton | 206/803 |
| 5,135,144 | 8/1992 | Blakely et al. | 224/240 |
| 5,186,900 | 2/1993 | Jenson et al. | 206/570 |
| 5,205,448 | 4/1993 | Kester et al. | 224/242 |
| 5,209,384 | 5/1993 | Anderson | 224/242 |

*Primary Examiner*—Henry J. Recla
*Assistant Examiner*—Gregory M. Vidovich
*Attorney, Agent, or Firm*—Waters & Morse, P.C.

[57] ABSTRACT

A blood collection tube holder includes a flexible waist band that is fastened around the waist of the person collecting blood samples; a storage pouch mounted on the band for storage of other articles used in the blood collection procedure; and a tube holder mounted in a secondary pouch attached to the storage pouch. The tube holder comprises tube receptacles that receive and releasably support a plurality of blood collection tubes in a stable, upright position and in a manually accessible location. The tube receptacles comprise flexible, cushioning sleeves with harder plastic tubular inserts having closed lower ends. The secondary pouch can be opened by a releasable fastener so that the interior of the pouch can be accessed for replacement of tube receptacles.

12 Claims, 3 Drawing Sheets

BLOOD COLLECTION TUBE HOLDER

CROSS REFERENCE TO RELATED APPLICATION

This application is a continuation-in-part of applicant's co-pending patent application, Ser. No. 08/257,685, filed Jun. 9, 1994.

BACKGROUND OF THE INVENTION

1. Field of the Invention

The present invention relates to a device for carrying blood sample containers and other implements used by persons collecting blood samples.

2. Description of Prior Art

Persons who collect blood samples, phlebotomists or other health care workers, carry with them a number of things necessary to perform this procedure. In addition, clinical procedures often require the taking of a plurality of blood samples from the same patient. As the blood sample tubes are disconnected from the needle, they should be held in a stable, upright position while additional tubes are being filled and while the needle and conduits are disconnected from the patient. This operation requires a high degree of skill, experience, and patience on the part of the blood collecting person. Once the samples have been taken, it is desirable to keep them together and carry them in a stable, upright position to the test facility.

In applicant's co-pending patent application, applicant discloses a wrist-mounted blood collection device, wherein a number of C-shaped, flexible tube holding devices are mounted on a base that is removably connected to an arm band as a unit. The present invention provides an alternative means for carrying blood collection tubes on a waist band device that also incorporates a storage pouch for additional implements that are frequently used by a phlebotomist. The waist band provides convenient out-of-the-way storage and does not require that anything be strapped to the wrist of the operator.

SUMMARY OF THE INVENTION

The present invention comprises a blood collection tube holder including a flexible band that can be wrapped around the waist or other portion of the anatomy of the person collecting blood samples; a releasable fastener for securing the band around the person's anatomy; and a tube holder attached to the band for receiving and releasably supporting a plurality of blood collection tubes in a stable, upright position and in a manually accessible location.

The waist band has a storage pouch attached thereto for storage of other articles used in the blood collection procedure or other patient care. The tube holder preferably is mounted in a secondary pouch attached to the outside of the storage pouch, with each tube holder providing a tubular receptacle having an open end that is accessible for insertion of a blood collection tube. Storage pouches are mounted around the waist or hips of the operator with the tube receptacles being manually accessible from an upper end. Desirably, the tube receptacles comprise a flexible, cushioning, tubular material that cushions as well as holds the tubes in an upright position, with a harder plastic tube serving as an insert in the cushioning sleeve. The insert provides a low coefficiency of friction and lets the blood collection tubes slide into and out of the receptacle easily. The secondary pouch can be opened by a releasable fastener so that the interior of the pouch can be accessed for tube removal or replacement of tube receptacles.

These and other advantages and features of the present invention are described in more detail below and shown in the appended drawings.

DETAILED DESCRIPTION OF THE PREFERRED EMBODIMENT

Figure 1:
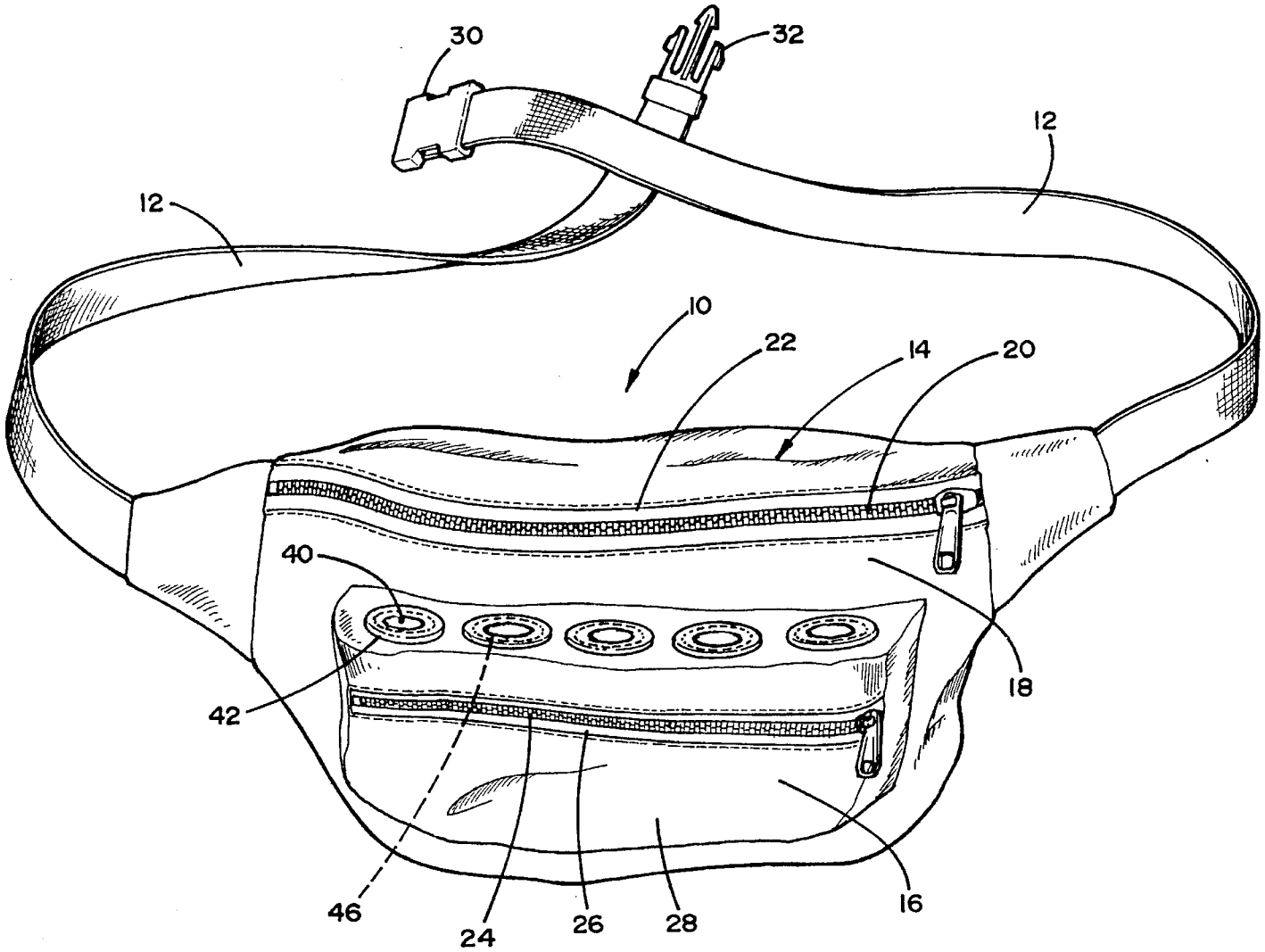
FIG. 1 is a pictorial front elevational view of the blood collection tube holder of the present invention.

Referring to the drawings, a blood collection tube holder 10 constructed in accordance with the present invention comprises an adjustable waist band or belt 12 connected to opposite sides to a rear storage pouch 14. A front pouch 16 is mounted on a front surface 18 of the rear storage pouch. A zipper 20 provides a releasable fastener for opening and closing an opening 22 in the upper portion of the rear storage pouch. A zipper 24 provides a releasable fastener for opening and closing an opening 26 in a front surface 28 of front pouch 16. The front pouch is smaller than the rear pouch.

The waist belt or band desirably is formed in two sections, with each section extending from an opposite side of the rear storage pouch and terminating in mating clasp or fastener members 30 and 32, with clasp members 30 and 32 providing a conventional, releasable fastener. An elastic band or other type of fastener could be used as an alternative.

While other constructions of this assembly are possible, the overall construction of the storage pouch and waist band mechanism can be the same as a conventional product known as a "fanny pack" used for storing articles for hiking or the like. The belt and pouches typically are formed of a durable, woven fabric, although other types of materials are possible and other types of fasteners are possible.

Figure 2:
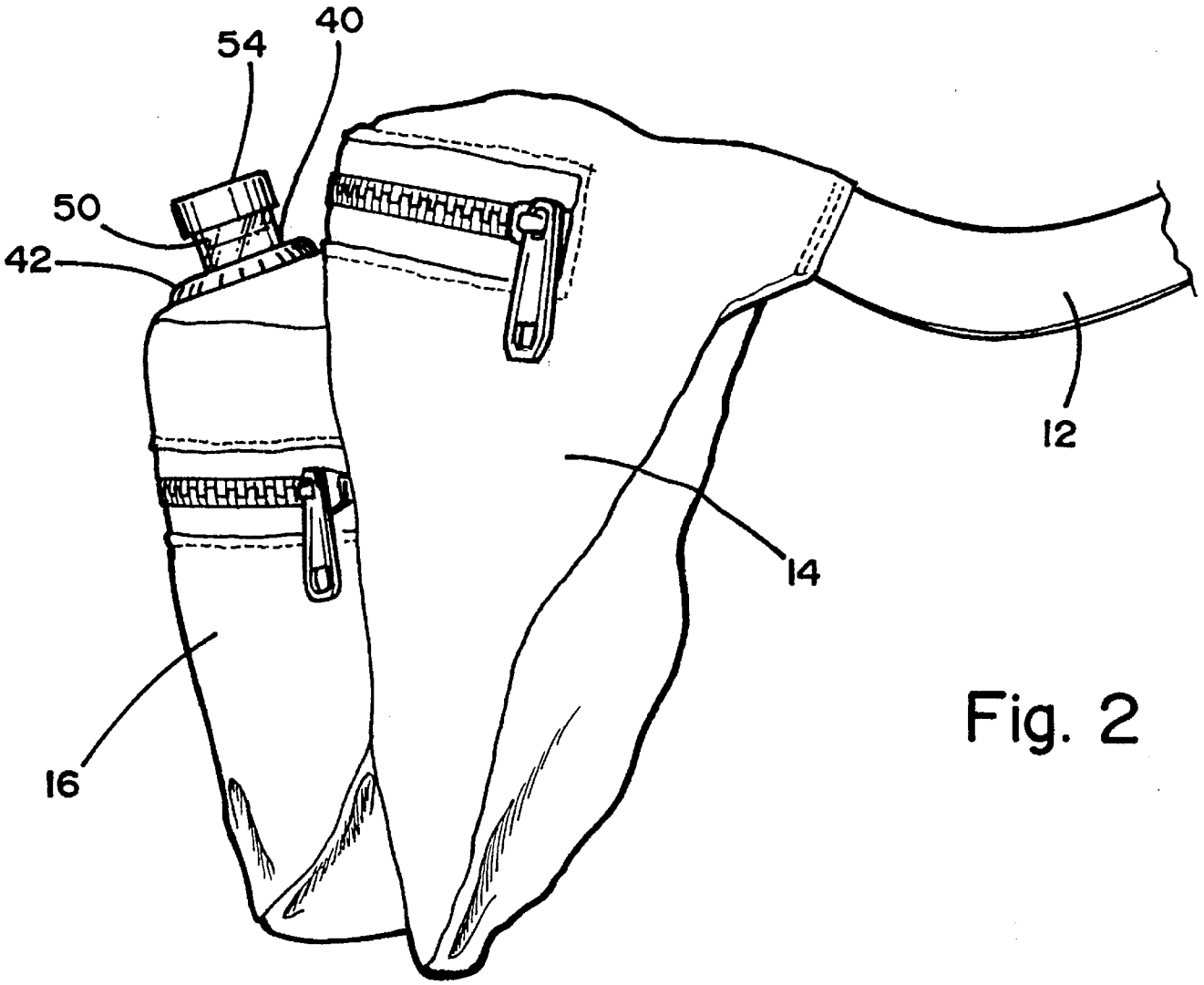
FIG. 2 is a side elevational view of the invention of FIG. 1.
Figure 3:
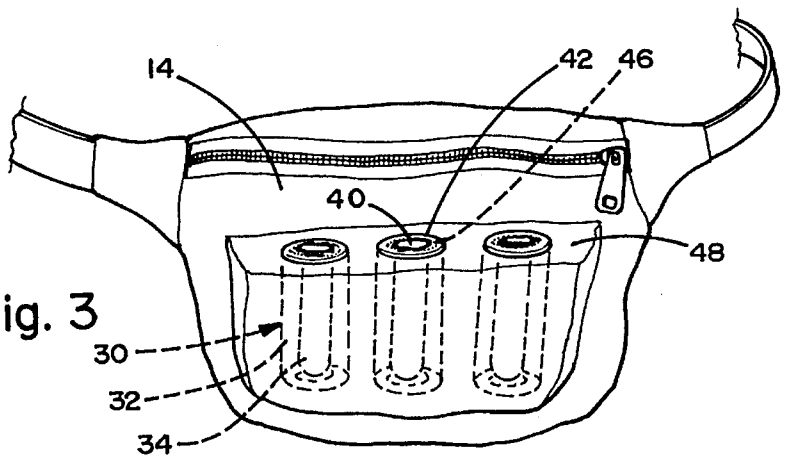
FIG. 3 is a partial front elevational view of the blood collection tube holder, showing the construction of the individual tube holders or receptacles.
Figure 4:
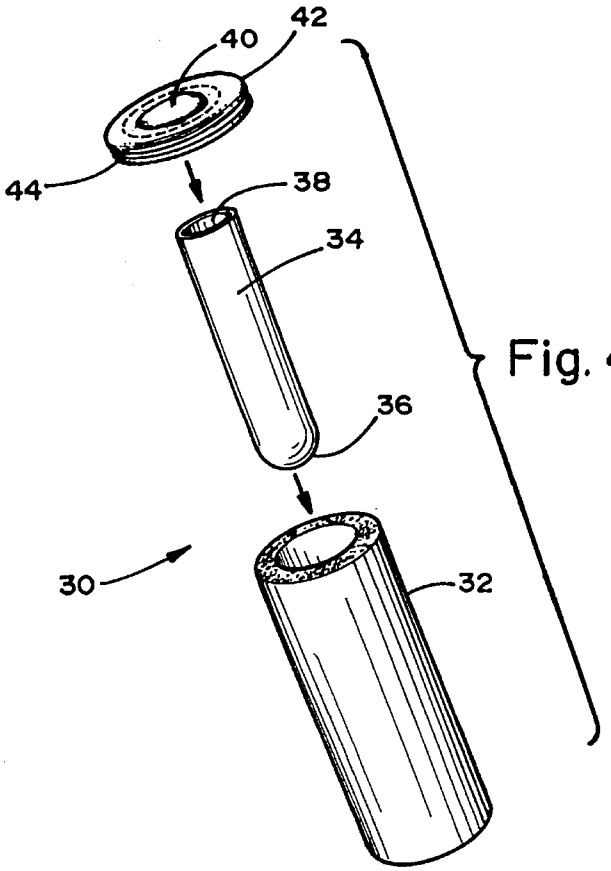
FIG. 4 is an exploded view of the individual blood collection tube holders employed in the present invention.

The front pouch 16 of the present invention incorporates a plurality of blood collection tube holders 30 that support tubes 50 (one of which is shown in FIG. 2) in a generally upright position, with the tube holders supporting the tubes in a slightly elevated position so that color-coded caps 54 on the blood collection tubes extend visibly out of the tube holder for easy identification. Referring to FIGS. 3 and 4, each tube holder comprises a tubular foam rubber protection sleeve 32 into which is fitted a plastic, polypropylene, tubular insert 34 having a closed end 36 and an open end 38. The open end 38 of the tubular insert fits into an opening 40 in a resilient grommet 42 formed of rubber or the like. Preferably, the end 38 is flared or ribbed outwardly slightly so as to prevent the grommet from pulling off of the end 38. Grommet 42 has a groove 44 extending around the outer periphery of the grommet. The grommet is a conventional product.

Referring again to FIG. 3, grommet 42 fits in a mating opening 46 in a generally horizontal upper surface 48 of the front pouch. The fabric around opening 46 fits into the groove 44 in the grommet, holding the grommet in place in the opening 46. Polypropylene insert 34 fits resiliently through the grommet, while the foam rubber protection sleeve fits resiliently on the polypropylene insert from the inside of the opening.

As shown in FIG. 3, when a plurality of tube holders are mounted in the front pouch, the foam rubber protection sleeves 32 for adjacent tube holders are next to each other and hold the tubes in a generally upright position, while cushioning the tubes. The polypropylene inserts provide a relatively smooth and hard inner surface or liner that provides further resistance to deflection, while at the same time making it easy to slip the blood collection tubes into and out of the tube holders for easy insertion and removal. The closed ends of the inserts hold blood collection tubes at the proper height. The zippers 24 in the front pouch can be opened and closed to make any adjustments to the tube holders that are desirable.

In the preferred practice of the present invention, the front pouch is provided with 4, 5, or 6 tube holders. These can be of different sizes, as determined by the polypropylene inserts. Polypropylene inserts desirably are provided in each of the following three sizes (with sizes being expressed in millimeters):

| OUTSIDE DIAMETER | LENGTH |
|---|---|
| 16.7 | 67 |
| 16.7 | 95 |
| 21.5 | 100 |

These three sizes are interchangeable and are attached by two different sizes of grommets, depending upon the outside diameter of the polypropylene tube. The tubes all fit into the same size of foam rubber protection sleeve, which is a vinyl nitrile foam tube in the preferred practice of the invention. The foam sleeve and polypropylene inserts are commercially available products.

Figure 5:
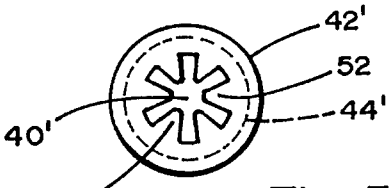
FIG. 5 is a plan view of an alternative embodiment of a grommet employed in the present invention.

While the use of a foam sleeve and plastic insert is desirable, the device is functional without the foam sleeve and also is functional with only a grommet or other tube holding member in the opening in the front pouch. An alternative grommet 42', shown in FIG. 5, includes peripheral groove 44' and opening 40'. Resilient inwardly extending fingers or projections 52 engage and hold a blood collection tube. This type of grommet can be used to hold tubes of different sizes.

The rear pouch of the present invention provides an important additional convenience. Health care professionals who collect blood, in their practice, typically move from patient to patient and carry a number of things with them in the pockets of their coats or pants or the like. The rear pouch provides a convenient single storage place for most of the things that a phlebotomist might need. The rear pouch is about 150 cubic inches in volume.

In use, the phlebotomist collects blood in a conventional manner by first inserting a needle into a patient and then collecting blood samples with one or more separate tubes that are individually removable from the needle assembly. The tubes, before and after they are filled, are held conveniently in one of the tube holders mounted on the front pouch of the waist pack. The tube holder holds the tube upright in a stable condition for storage until all desired tubes are filled with blood and stored in the adjacent tube holders. The phlebotomist then has both hands free to remove the needle from the patient and complete the procedure before proceeding to the laboratory to deliver the blood sample tubes for testing.

Individual tube holders of the present invention are easily changed and rearranged in the pouch to provide just the right combination of tube holders for the phlebotomist's needs. These can be changed easily by simply snapping out the grommet and inserting a new grommet and polypropylene insert. The procedure takes little time and provides a wide variation of combinations of tubes for storage in the device. Other sizes of polypropylene inserts can be employed for any other purpose that the phlebotomist may have, although the three configurations discussed above are generally satisfactory for most applications.

It should be understood that the foregoing is merely representative of the preferred practice of the present invention and that various changes in the arrangements and details of construction of the invention may be made without departing from the spirit and scope of the present invention, which is defined in the appended claims.

I claim:

1. A blood collection tube holder comprising:

a waist band that fits around the waist of a person collecting blood samples, the waist band including means for holding the waist band on the waist of said person;

a storage pouch on the waist band, the storage pouch having an open interior that is capable of holding supplies used by said blood collection person; and a plurality of blood collection tube receptacles supported by the storage pouch, the receptacles each being sized and positioned so as to receive and support blood collection tubes respectively in a generally upright position, the blood collection tube receptacles being mounted in respective openings in a top surface of a secondary pouch positioned on a side of the storage pouch, the secondary pouch having a closable opening other than the tube openings in the top surface thereof, the closable opening leading to the interior of the secondary pouch, the tube receptacles having open tops shaped such that blood collection tubes of a selected size fit into the receptacles.

2. A blood collection tube holder according to claim 1 wherein the receptacles comprise tubular inserts mounted in the secondary pouch in mating alignment with the openings in the top surface of the secondary pouch and the open tops of the receptacles, the tubular inserts having open upper ends and closed lower ends, the inserts receiving the blood collection tubes in their open upper ends.

3. A blood collection tube holder according to claim 2, wherein at least one of the tubular inserts is covered by a resilient foam sleeve.

4. A blood collection tube holder according to claim 2 wherein the open tops of the tube receptacles comprise annular grommets secured in the openings in the top surface of the secondary pouch, the inserts removably fitting in openings in the grommets.

5. A blood collection tube holder according to claim 1 wherein the open tops of the tube receptacles comprise annular grommets secured in the openings in the top surface of the secondary pouch, the grommets including interior openings, with resilient projections extending into the openings in the grommets, the resilient projections resiliently engaging blood collection tubes inserted into the openings through the grommets.

6. A blood collection tube holder according to claim 4 wherein the grommets include peripheral grooves in outer edges of the grommets that engage the edges of the openings in the top surface of the secondary pouch, the grommets being removable to replace the inserts with inserts of different sizes for blood collection tubes of different sizes.

7. A blood collection tube holder according to claim 1 wherein the storage and secondary pouches are formed of a flexible sheet material, with the storage pouch having a closable openings that provides access to the interior of the storage pouche.

8. Blood collection apparatus comprising, in combination, a plurality of blood collection tubes of predetermined sizes and a blood collection tube holder that releasably holds the tubes, the tube holder comprising:

a waist band that fits around the waist of a person collecting blood samples, the waist band including means for holding the waist band on the waist of said person;

a storage pouch on the waist band, the storage pouch including a primary pouch having an open interior that is capable of holding supplies other than blood collection tubes that are used by a blood collection person, the storage pouch further including a secondary pouch attached to the primary pouch, the secondary pouch having a closable opening leading to the interior thereof;

a plurality of blood collection tube receptacles supported in tube receptacle openings in a top surface of the secondary pouch, the tube receptacles comprising tubular support members having access openings that are sized and positioned so as to receive and support the blood collection tubes in a generally upright position.

9. Blood collection apparatus according to claim 8, wherein the tubular members comprise tubular inserts mounted in the secondary pouch in mating alignment with the openings in the top surface of the secondary pouch, the tubular inserts having open upper ends and closed lower ends, the inserts receiving the blood collection tubes in their open upper ends.

10. Blood collection apparatus according to claim 9, wherein at least one of the tubular inserts is covered by a resilient foam sleeve.

11. Blood collection apparatus according to claim 8, wherein the tube receptacles comprise annular grommets secured in the openings in the top surface of the secondary pouch, the inserts removably fitting in openings in the grommets.

12. Blood collection apparatus according to claim 8, wherein the tube receptacles comprise annular grommets secured in the openings in the top surface of the secondary pouch, the grommets including interior openings, with resilient projections extending into the openings in the grommets, the resilient projections resiliently engaging blood collection tubes inserted into the openings through the grommets.

* * * * *